US010286692B2

(12) United States Patent
Murotani et al.

(10) Patent No.: US 10,286,692 B2
(45) Date of Patent: May 14, 2019

(54) MEDIUM TRANSPORT DEVICE, PRINTING APPARATUS AND LIQUID EJECTING APPARATUS

(71) Applicant: SEIKO EPSON CORPORATION, Tokyo (JP)

(72) Inventors: Tomoya Murotani, Shiojiri (JP); Mitsutaka Ide, Shiojiri (JP); Hiroyuki Kobayashi, Shimosuwa-Machi (JP); Hideyuki Kataoka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/923,243

(22) Filed: Mar. 16, 2018

(65) Prior Publication Data

US 2018/0207963 A1 Jul. 26, 2018

Related U.S. Application Data

(63) Continuation of application No. 15/129,233, filed as application No. PCT/JP2015/001792 on Mar. 27, 2015, now Pat. No. 9,981,489.

(30) Foreign Application Priority Data

Mar. 27, 2014 (JP) ..... 2014-067092
Mar. 27, 2014 (JP) ..... 2014-067093

(51) Int. Cl.
*B41J 13/00* (2006.01)
*B41J 11/00* (2006.01)
(Continued)

(52) U.S. Cl.
CPC ..... *B41J 13/0009* (2013.01); *B41J 11/009* (2013.01); *B41J 11/0085* (2013.01);
(Continued)

(58) Field of Classification Search
CPC .... B41J 13/0009; B41J 11/009; B41J 11/0095
See application file for complete search history.

(56) References Cited

U.S. PATENT DOCUMENTS

2013/0135407 A1* 5/2013 Abe ..... B41J 15/16 347/102
2013/0141487 A1* 6/2013 Abe ..... B41J 11/00 347/16
(Continued)

FOREIGN PATENT DOCUMENTS

JP 2010-249614 11/2010
JP 2011-235476 11/2011
(Continued)

OTHER PUBLICATIONS

International Search Report and Written Opinion issued in PCT/JP2015/001792 dated Jun. 23, 2015.

*Primary Examiner* — Henok D Legesse
(74) *Attorney, Agent, or Firm* — Workman Nydegger

(57) ABSTRACT

A printer includes a transport unit that transports continuous paper, a medium support unit in which a support surface that is capable of supporting continuous paper that is transported by a transport unit, and first concave sections, which are indented from the support surface, are formed, and an image capture unit, which is disposed on a lower side of the support surface, and which captures an image of a lower surface of the continuous paper.

11 Claims, 9 Drawing Sheets

(51) Int. Cl.
*B65H 26/02* (2006.01)
*B41J 11/06* (2006.01)

(52) U.S. Cl.
CPC ..... *B41J 11/0095* (2013.01); *B41J 11/06* (2013.01); *B65H 26/02* (2013.01); *B65H 2301/51214* (2013.01); *B65H 2404/143* (2013.01); *B65H 2404/61* (2013.01); *B65H 2515/112* (2013.01); *B65H 2553/414* (2013.01); *B65H 2701/172* (2013.01); *B65H 2701/173* (2013.01); *B65H 2701/174* (2013.01); *B65H 2801/15* (2013.01)

(56) References Cited

U.S. PATENT DOCUMENTS

| | | | |
|---|---|---|---|
| 2013/0208065 | A1 | 8/2013 | Yamamoto et al. |
| 2014/0132687 | A1 | 5/2014 | Abe et al. |
| 2015/0002574 | A1 | 1/2015 | Abe |
| 2017/0106675 | A1 | 4/2017 | Murotani et al. |

FOREIGN PATENT DOCUMENTS

| | | |
|---|---|---|
| JP | 2013-119439 | 6/2013 |
| JP | 2013-163283 | 8/2013 |
| JP | 2014-094500 | 5/2014 |

* cited by examiner

[Fig. 1A]
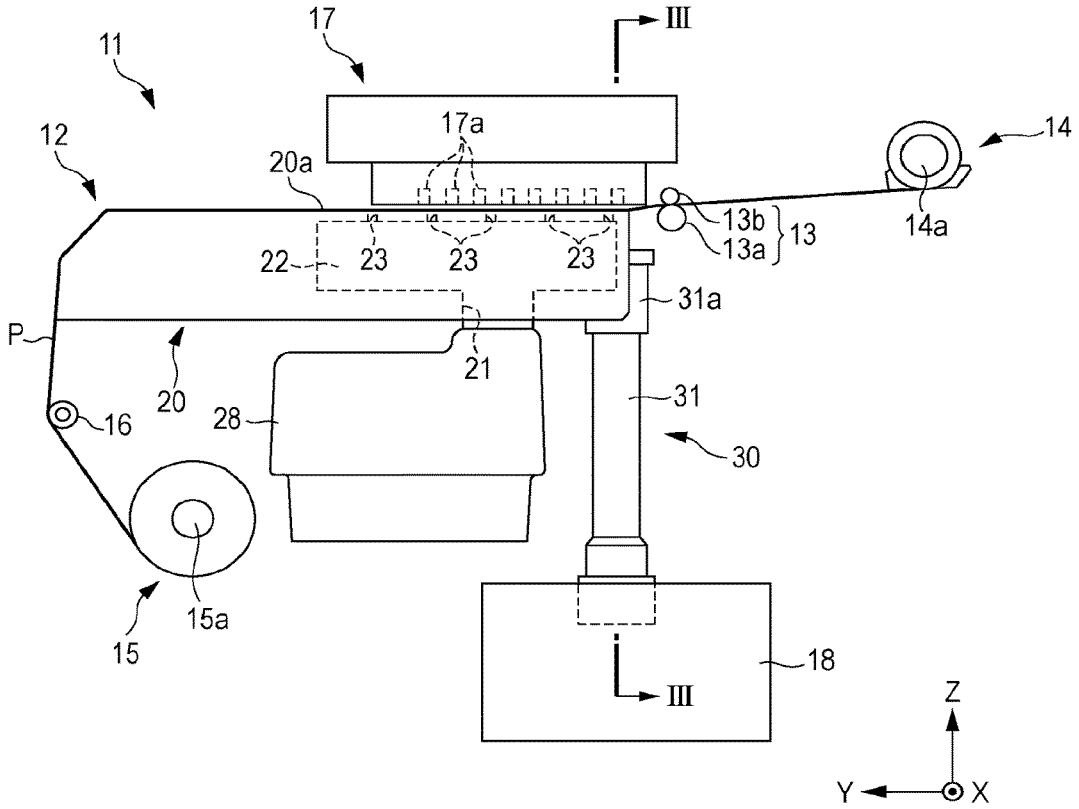
[Fig. 1B]
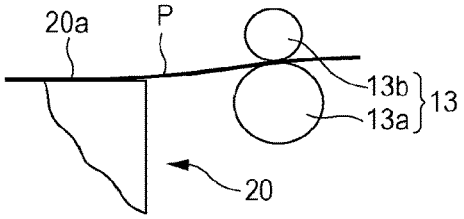

[Fig. 2A]
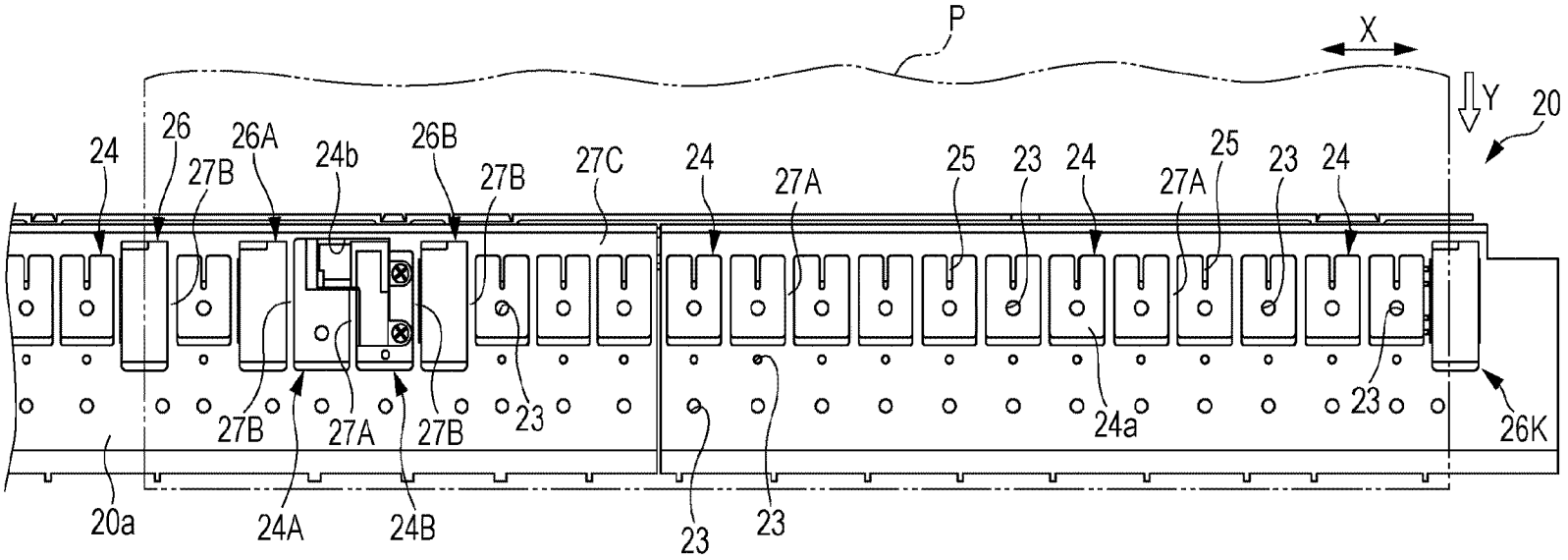

[Fig. 2B]
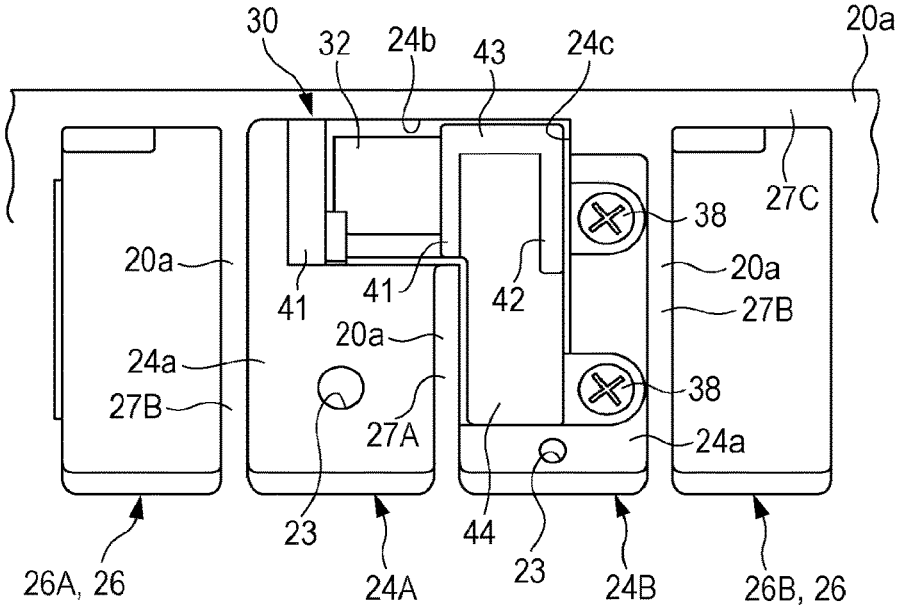

[Fig. 3]
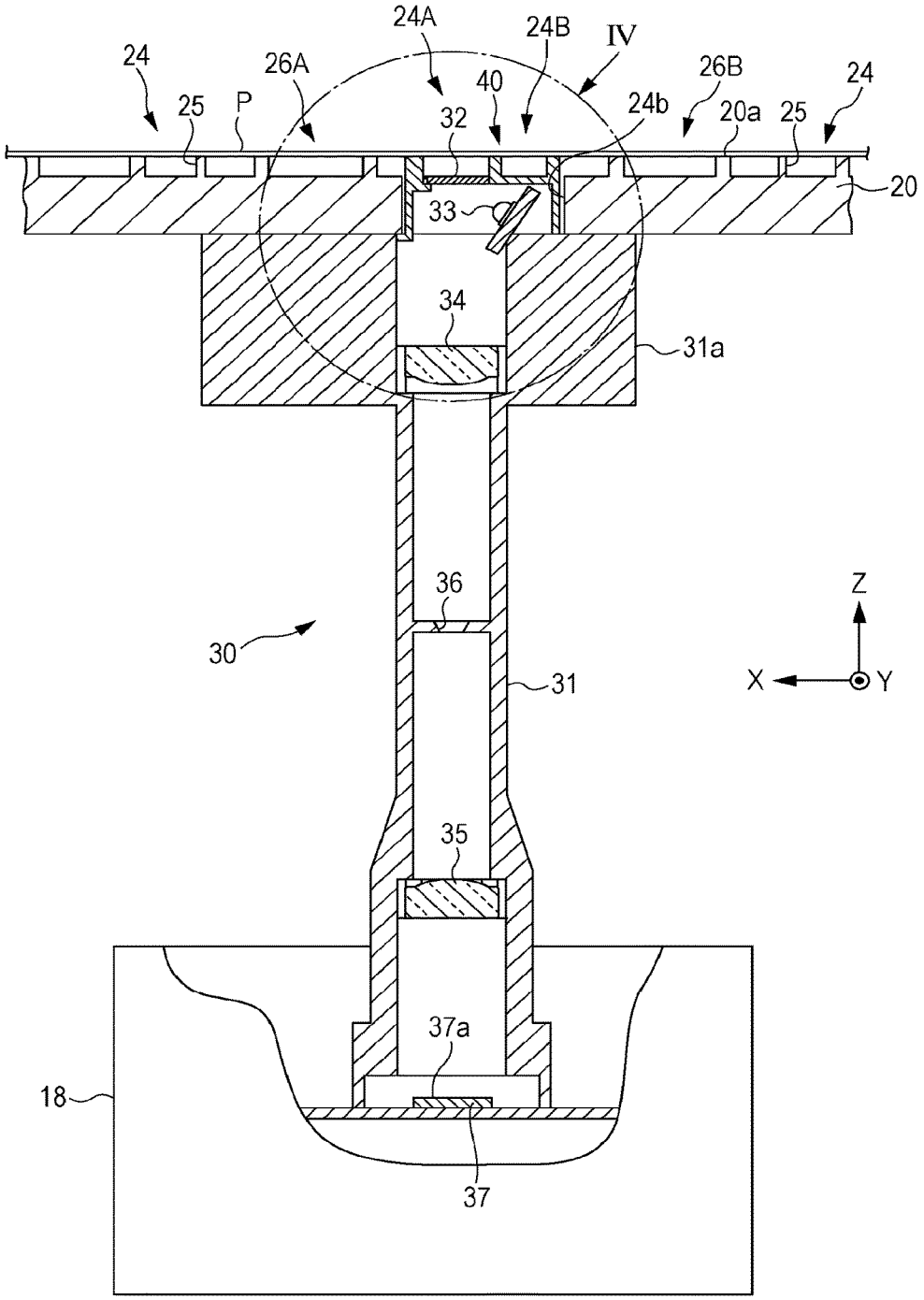

[Fig. 4]
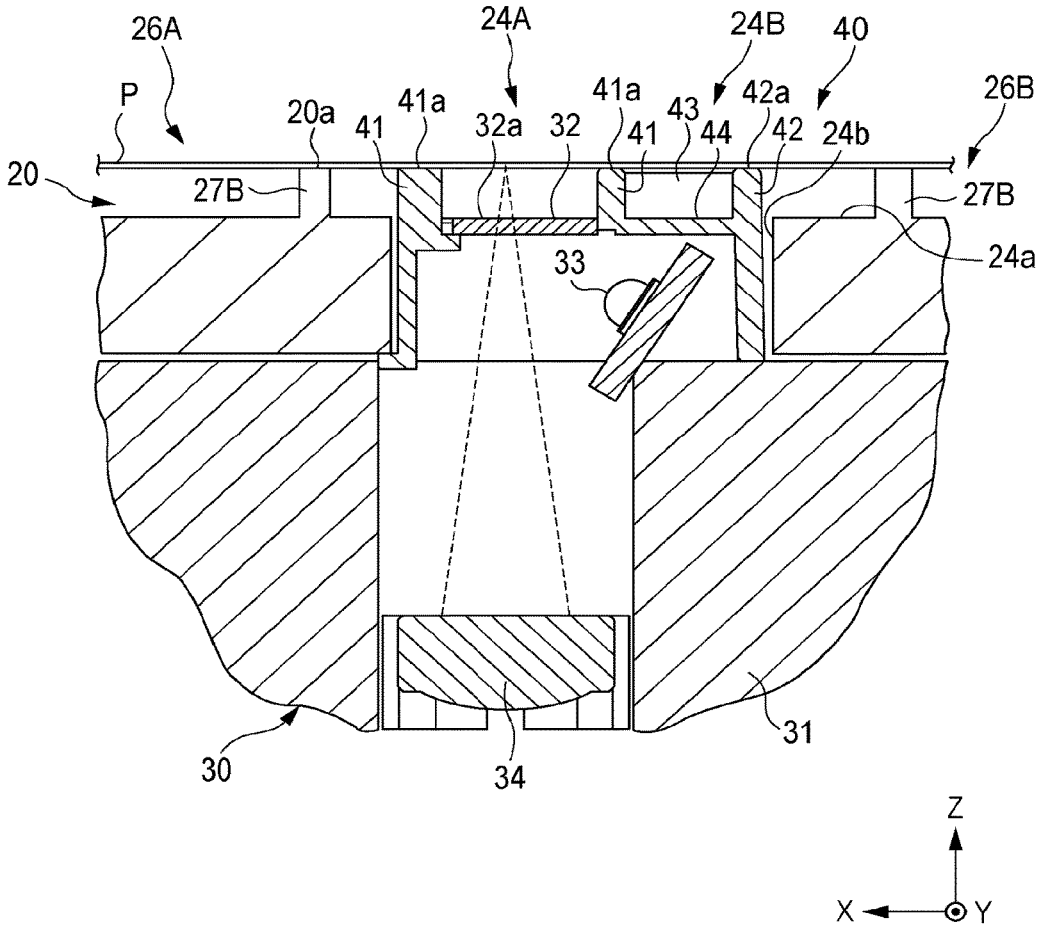

[Fig. 5]
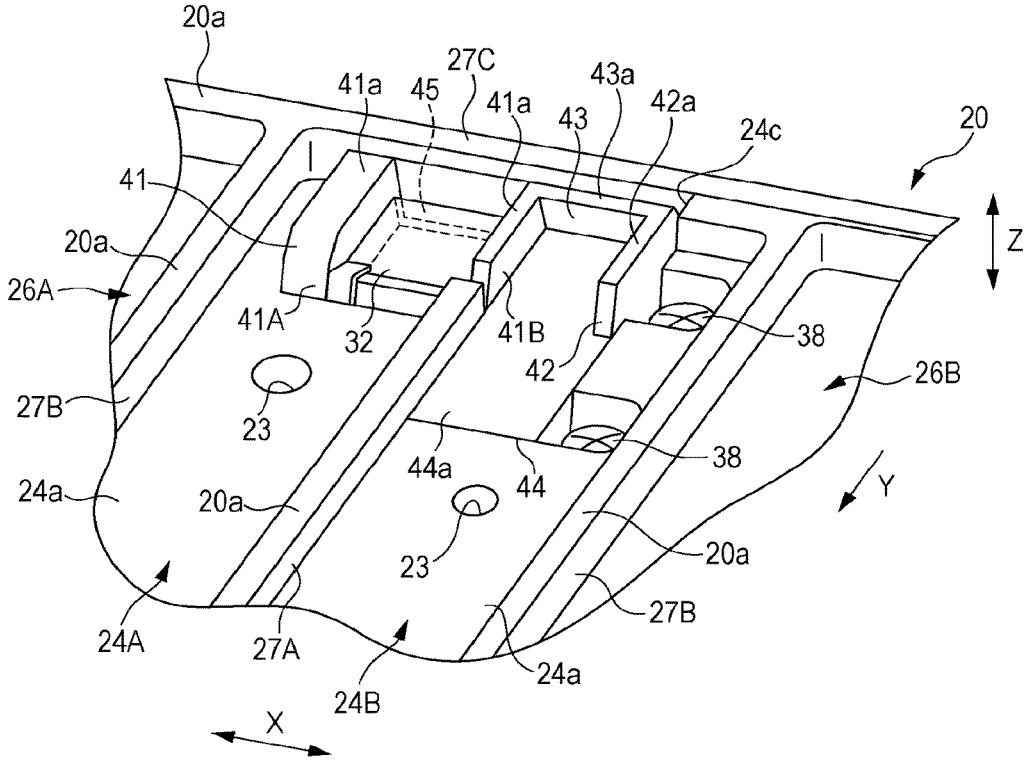

[Fig. 6]
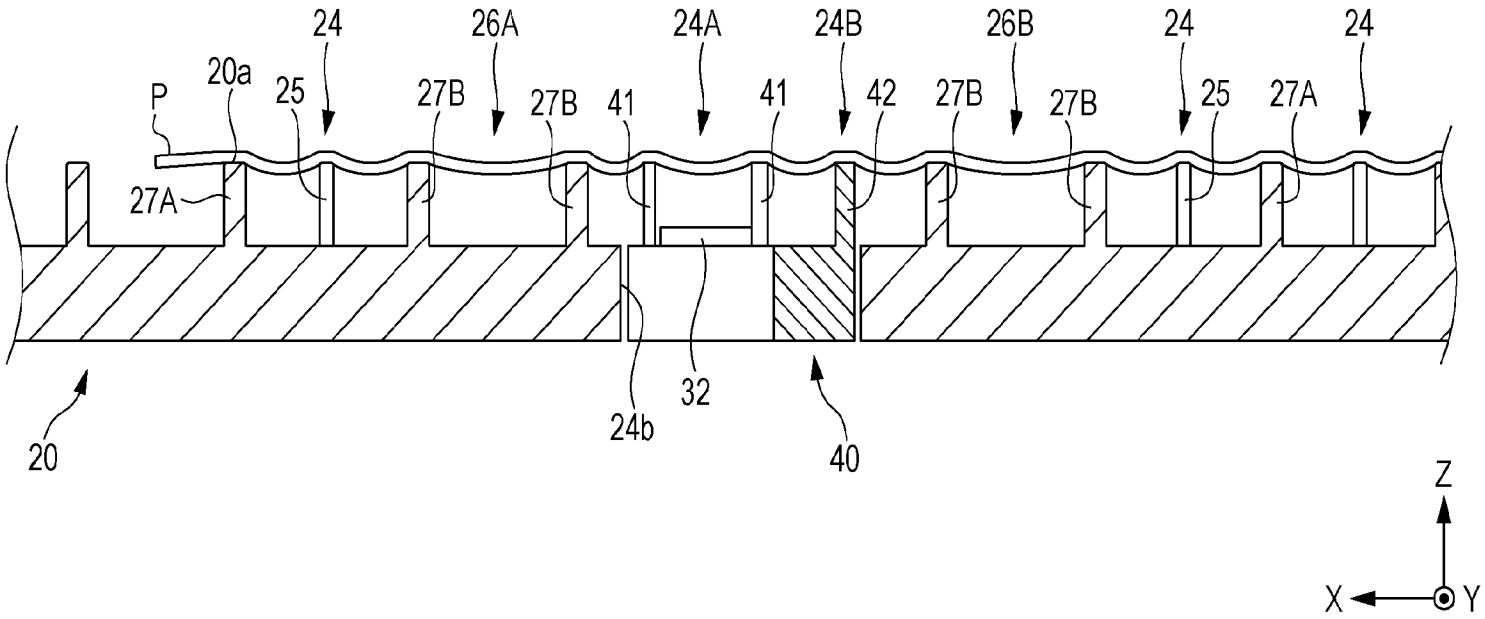

[Fig. 7]
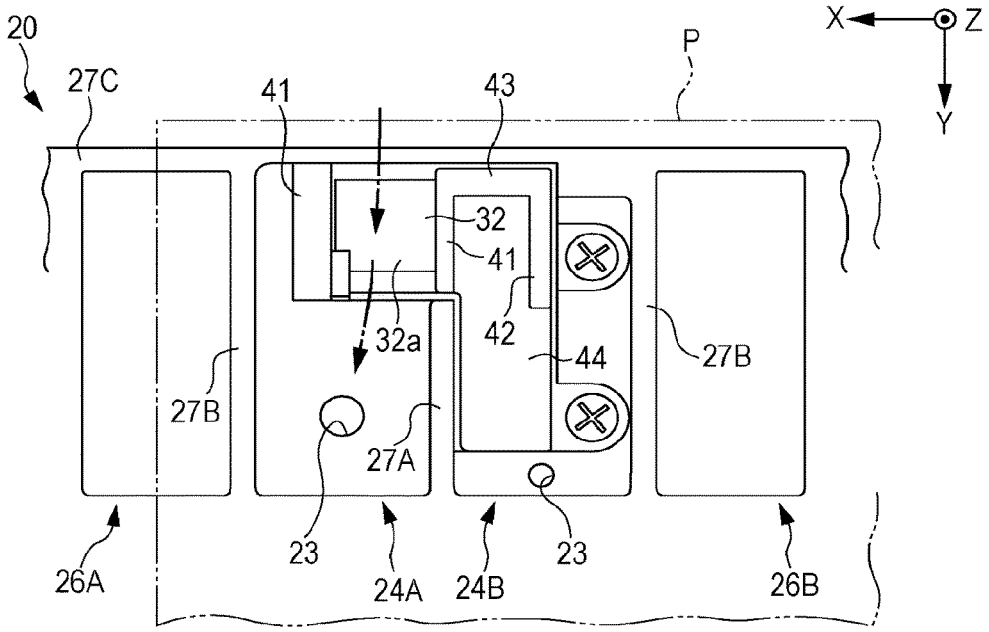
[Fig. 8]
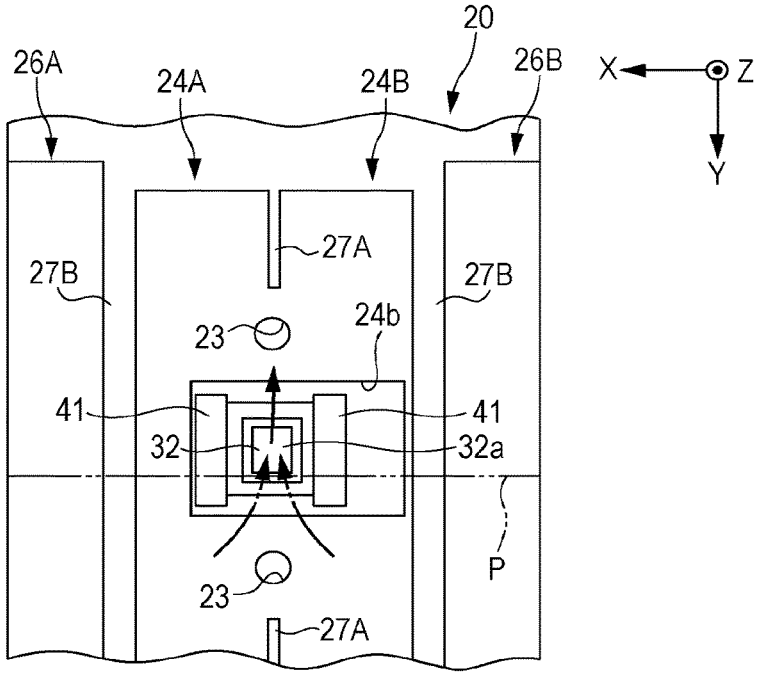

[Fig. 9]
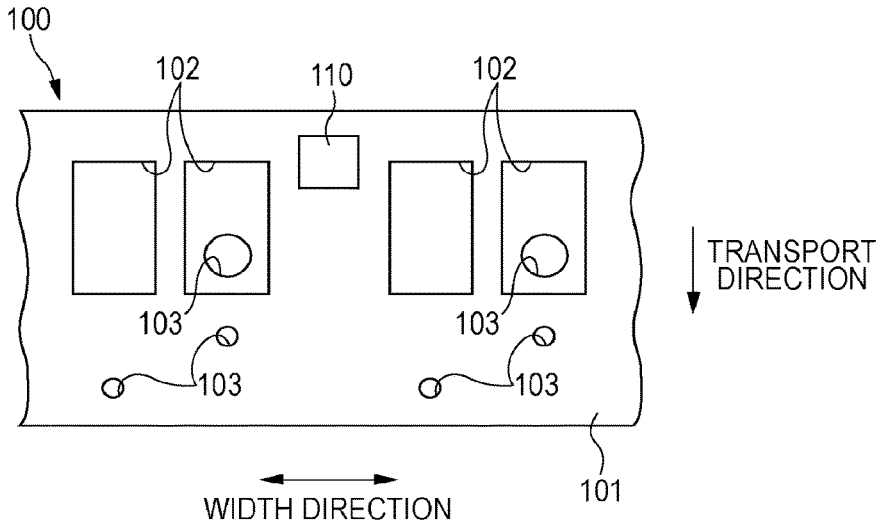

MEDIUM TRANSPORT DEVICE, PRINTING APPARATUS AND LIQUID EJECTING APPARATUS

CROSS-REFERENCE TO RELATED APPLICATIONS

This application is a continuation of U.S. patent application Ser. No. 15/129,233 filed on Sep. 26, 2016, entitled "MEDIUM TRANSPORT DEVICE, PRINTING APPARATUS AND LIQUID EJECTING APPARATUS," which issued as U.S. Pat. No. 9,981,489 on Apr. 29, 2018, which is a 371 of PCT Application Serial No. PCT/JP2015/001792 filed on Mar. 27, 2015, entitled "MEDIUM TRANSPORT DEVICE, PRINTING APPARATUS AND LIQUID EJECTING APPARATUS," which claims priority to Japanese Patent Application No. 2014-067092, filed Mar. 27, 2014, and Japanese Patent Application No. 2014-067093, filed Mar. 27, 2014, wherein all of the foregoing are incorporated herein by reference in their entireties.

BACKGROUND OF THE INVENTION

1. Technical Field of the Invention

Embodiments of the present invention relate to a medium transport device that transports a medium such as a sheet of paper, a printing apparatus that is provided with such a device, and a liquid ejecting apparatus that ejects a liquid onto a medium.

2. Background Art

As a medium transport device that transports a medium such as a sheet of paper, a medium transport device that is configured so that an image capture unit is provided in a medium support unit that supports a medium, an image of the texture of a lower surface of a medium that passes over the medium support unit is captured by the image capture unit, and a transport weight of the medium is detected on the basis of the captured image, is known. In the medium transport device, an opening section for irradiating light from the image capture unit toward a lower surface of a medium is formed on a support surface of the medium support unit. Further, a light-transmitting member for allowing the transmission of light while suppressing the entry of foreign substances such as paper powder and dust into the inside of the image capture unit is disposed in the opening section.

As this kind of medium transport device, for example, the medium transport device of PTL 1 performs a template matching process that locates a position at which a degree of similarity with an image that was captured on a previous occasion is greatest while moving a template of a rectangular region that is set in advance over an image that is captured on a current occasion in order to detect a transport weight of the medium. That is, the medium transport device of PTL 1 calculates a distance in a transport direction of a position of a template in an image that was captured on a previous occasion and a position of a template in an image that is matched and captured on a current occasion as a transport weight of the medium.

As shown in FIG. 4 of PTL 1, in the medium transport device of PTL 1, an upper surface of the light-transmitting member that is disposed in the opening section of the medium support unit is flush with a support surface, and a focal position of the image capture unit is aligned with the support surface. That is, the medium transport device is adjusted so that the focal position of the image capture unit becomes an upper surface of the light-transmitting member.

In addition, as a liquid ejecting apparatus that ejects a liquid such as an ink from an ejecting unit onto a medium such as a sheet of paper, a liquid ejecting apparatus that is configured so that an image capture unit is provided in a medium support unit that supports a medium, an image of the texture of a lower surface of a medium that passes over the medium support unit is captured by the image capture unit, and a transport weight of the medium is detected on the basis of the captured image, is known. In this kind of liquid ejecting apparatus, an opening section for irradiating light from the image capture unit toward a lower surface of a medium is formed on a support surface of the medium support unit (for example, refer to PTL 1).

In this kind of liquid ejecting apparatus, for example, in a case in which a large amount of liquid is ejected onto a medium from the ejecting unit in the manner of that used during solid printing or the like, there are case in which the medium swells as a result of absorbing a large amount of liquid, and therefore, the medium after printing becomes wavy with respect to the support surface of the medium support unit, and so-called cockling is generated.

In such a case, there is a concern that portions of the medium that have become deformed in a bending manner in a direction that rises from the support surface due to the cockling phenomenon will come into contact with the ejecting unit.

In such an instance, as shown in FIG. 9, in this kind of liquid ejecting apparatus, a plurality of concave sections 102 are formed on a support surface 101 of a medium support unit 100, and suction holes 103 are formed on the support surface 101 at a plurality of points including a bottom surface region of a portion of the concave sections 102. Further, it is configured so that the medium is adsorbed to a support surface 101 side by driving a suction fan (not shown in the drawing) that is in communication with each suction hole 103.

CITATION LIST

Patent Literature

PTL 1: JP-A-2013-119439

BRIEF SUMMARY OF THE INVENTION

According to the medium transport device of PTL 1, since a focal position of the image capture unit coincides with an upper surface of the light-transmitting member, the focal position of the image capture unit meets foreign substances when foreign substances are attached to the upper surface of the light-transmitting member. As a result of this, since the image capture unit captures images of foreign substances clearly, the effect of foreign substances on an image of the texture of a lower surface of a captured medium is increased. Therefore, in the medium transport device of PTL 1, there is a concern that a template position in an image that is captured on the current occasion that differs from a template position that should be matched will be set as a position at which the degree of similarity is greatest, and therefore, the transport weight of the medium will be calculated when performing the template matching process on the basis of the incorrect template position. Therefore, there is a concern that there will be a deterioration in the precision of detection of the transport weight of a medium.

In addition, in the liquid ejecting apparatus of PTL 1, as shown in FIG. 9, the light-transmitting member 110 of the image capture unit is disposed between a plurality of concave sections 102 in a width direction of the medium support unit 100. That is, on the support surface 101 of the medium support unit 100, a disposition region of the light-transmitting member 110 and a region of a predetermined width that is continuous from the disposition region to a downstream side in the transport direction of the medium becomes a region in which the concave sections 102 are not formed. Therefore, in this region with a predetermined width, it is not possible to support the medium since the medium is displaced further in a direction that becomes separated from the ejecting unit than the support surface 101, and therefore, in cases in which portions of the medium that have become deformed in a bending manner in a direction that rises from the support surface 101 due to the cockling phenomenon, there is still a concern that the portions will come into contact with the ejecting unit.

Embodiments of the invention is made by considering the above-described situations and object thereof is to provide a medium transport device that is capable of suppressing deteriorations in the detection quality of the transport weight of a medium, and a printing apparatus that is provided with such a device. In addition, another advantage of some aspects of the invention is to provide a liquid ejecting apparatus that, in a case in which a light-transmitting member, which transmits light for medium image capture from an image capture unit, is disposed on a support surface of a medium support unit that faces an ejecting unit, can even reduce a concern that portions of a medium that are deformed in a bending manner will come into contact with the ejecting unit in a case in which portions of the medium that are deformed in a bending manner are positioned on the light-transmitting member.

Hereinafter, means of the invention, and operational effects thereof will be described.

A medium transport device for solving the above-described problems includes a transport unit that transports a medium, an image capture unit that captures an image of the medium that is transported by the transport unit from a first side in a front-rear direction of the medium, and a control unit that detects a transport weight of the medium that is transported by the transport unit on the basis of an image that is captured by the image capture unit, and controls the transport unit on the basis of the transport weight of the medium, in which the image capture unit is provided with an optical member, light-transmitting members which are disposed further on a second side in the front-rear direction of the medium than the optical member, and which transmit light for medium image capture from the image capture unit, and a support member, to which the light-transmitting members are fixed, and which supports the medium further on the second side in the front-rear direction of the medium than the light-transmitting members, and a focal position of the optical member is positioned further on the second side in the front-rear direction of the medium than a surface of the second side of the light-transmitting members.

A liquid ejecting apparatus for solving the above-described problems includes a transport unit that transports a medium, an ejecting unit that ejects a liquid onto the medium that is transported by the transport unit, a medium support unit, which has a support surface that is capable of supporting the medium that is transported by the transport unit in a manner in which the medium faces the ejecting unit, and in which a plurality of concave sections, which are indented in a direction that becomes separated from the ejecting unit, are formed in the support surface, and an image capture unit, which is disposed on a side that is opposite to the ejecting unit with the support surface as a reference, and which captures an image of a surface of a side of the medium that is opposite to a surface that faces the ejecting unit, in which opening sections are formed inside the concave sections, and light-transmitting members, which transmit light for medium image capture from the image capture unit, are disposed in the opening sections.

BRIEF DESCRIPTION OF THE DRAWINGS

FIG. 1A is a schematic configuration view of an ink jet type printer of an embodiment.

FIG. 1B is an enlarged view of a pair of paper supply rollers in FIG. 1A and the periphery thereof.

FIG. 2A is a plan view of a portion of a medium support unit.

FIG. 2B is an enlarged view of a first concave section and a second concave section in FIG. 2A.

FIG. 3 is a cross-sectional view of a line in FIG. 1A.

FIG. 4 is an enlarged view of a dashed-dotted line circle IV in FIG. 3.

FIG. 5 is a perspective view of a first concave section and the periphery thereof.

FIG. 6 is a cross-sectional view of a portion of the medium support unit.

FIG. 7 is a plan view of a portion of the medium support unit.

FIG. 8 is a plan view of a portion of a medium support unit of a modification example.

FIG. 9 is a plan view of a portion of a medium support unit of the related art.

DETAILED DESCRIPTION OF THE PREFERRED EMBODIMENTS

Hereinafter, an embodiment in which a printing apparatus and a liquid ejecting apparatus have been implemented in an ink jet type printer will be described according to the drawings.

As shown in FIG. 1A, the ink jet type printer (hereinafter, a "printer 11") as an example of a printing apparatus and a liquid ejecting apparatus a transport device 12, which is an example of a medium transport device that transports long-sheet continuous paper P, which is an example of a medium, and an ejecting unit 17, which is an example of a printing unit that performs printing by ejecting ink, which is an example of a liquid, onto the continuous paper P that is transported by the transport device 12. In addition, the printer 11 is provided with control unit 18 that controls the transport device 12 and the ejecting unit 17.

The transport device 12 is provided with a dispatch unit 14 that dispatches the continuous paper P, and a winding unit 15 that winds continuous paper P that is dispatched from the dispatch unit 14 on which printing has been performed by the ejecting unit 17. In FIGS. 1A and 1B, while the dispatch unit 14 is disposed in a position that is on a right side of the continuous paper P, which is an upstream side in a transport direction Y (a left direction in FIGS. 1A and 1B), the winding unit 15 is disposed in a position that is on a left side thereof, which is a downstream side.

The ejecting unit 17 is disposed so as to face a transport pathway of the continuous paper P in a position that is between the dispatch unit 14 and the winding unit 15. A plurality of nozzles 17*a* for ejecting ink onto the continuous paper P are formed in a surface of the ejecting unit 17 that faces the transport pathway of the continuous paper P.

In addition, in the transport device 12, a medium support unit 20 that supports the continuous paper P is disposed in a position that faces the ejecting unit 17 with the transport pathway of the continuous paper P interposed therebetween. The medium support unit 20 forms a bottomed rectangular box shape in which an open section 21 is formed on a lower surface side that is a side that is opposite to the ejecting unit 17.

A suction fan 28, which is an example of a suction unit that suctions air inside an internal airspace 22 of the medium support unit 20, is provided on the lower surface of the medium support unit 20 so as to fill the open section 21. A surface of the medium support unit 20 that faces the ejecting unit 17 is set as a flat support surface 20*a* that supports the continuous paper P that is transported. A plurality of suction holes 23 for adsorbing the continuous paper P to the support surface 20*a* are formed in the medium support unit 20. Each suction hole 23 is in communication with the internal airspace 22 of the medium support unit 20. According to this kind of configuration, an airspace between the continuous paper P and the medium support unit 20 is set to a negative pressure through the internal airspace 22 and the suction holes 23 as a result of air being taken in due to the suction fan 28 being driven in a rotational manner with the open section 21 as an intake opening. As a result of this, a suction force for adsorbing the continuous paper P to the support surface 20*a* is applied to the continuous paper P.

An image capture unit 30 for detecting a transport weight of the continuous paper P in a contactless manner is attached to a lower portion of the medium support unit 20. The image capture unit 30 captures an image of the texture of a lower surface (a non-printing surface) of the continuous paper P, and transmits the image to the control unit 18, which is attached to a lower portion of the image capture unit 30. The control unit 18 controls the transport weight of the continuous paper P on the basis of an image from the image capture unit 30 using a well-known technique such as that disclosed in PTL 1, for example.

A dispatch shaft 14*a* that extends in a width direction X (a direction that is orthogonal to a paper surface in FIGS. 1A and 1B) of the continuous paper P, which is a direction that is orthogonal to the transport direction Y of the continuous paper P, is provided in the dispatch unit 14 in a manner in which the dispatch shaft 14*a* is capable of being driven in a rotational manner. The continuous paper P is supported on the dispatch shaft 14*a* in a state of being wound in roll form in a manner in which the continuous paper P is capable of being rotated integrally with the dispatch shaft 14*a*. Further, the continuous paper P is dispatched from the dispatch shaft 14*a* toward a downstream side of the transport pathway of the continuous paper P as a result of the dispatch shaft 14*a* being driven in a rotational manner.

A pair of paper supply rollers 13, which is an example of a transport unit that clamps and guides the continuous paper P that is transported from the dispatch shaft 14*a* to the support surface 20*a*, is disposed diagonally downward of the dispatch shaft 14*a*. The pair of paper supply rollers 13 is disposed in a position that is adjacent in the transport direction Y to an upstream side end portion of the medium support unit 20 in the transport direction Y. The pair of paper supply rollers 13 includes a paper supply roller 13*a* that is provided in a manner in which the paper supply roller 13*a* is capable of being driven in a rotational manner, and a paper pressing roller 13*b* that is driven by rotation of the paper supply roller 13*a*. As shown in FIG. 1B, a position at which the continuous paper P is interposed by the paper supply roller 13*a* and the paper pressing roller 13*b* is positioned further on an upstream side of the medium support unit 20 than the support surface 20*a*.

As shown in FIG. 1A, a tension roller 16 for adjusting the tension of a region of the continuous paper P on which printing has been completed is disposed in the transport pathway of the continuous paper P on a downstream side of the support surface 20*a* in the transport direction Y. The winding unit 15 is disposed on a downstream side of the tension roller 16 in the transport pathway of the continuous paper P.

A winding shaft 15*a* that extends in the width direction X of the continuous paper P is provided in the winding unit 15 in a manner in which the winding shaft 15*a* is capable of being driven in a rotational manner. Further, continuous paper P on which printing has been completed that is transported from a side of the tension roller 16 is sequentially wound by the winding shaft 15*a* as a result of the winding shaft 15*a* being driven in a rotational manner.

Next, a configuration of the medium support unit 20 will be described in detail using FIGS. 2A, 2B and 3.

As shown in FIG. 2A, a plurality of first concave sections 24, which are examples of the concave sections that are open on a side of the ejecting unit 17 (refer to FIGS. 1A and 1B) and indented downward from the support surface 20*a*, and a plurality of second concave sections 26, which, while being indented in the same manner as the first concave sections 24, have a different shape to the first concave sections 24, are formed in the medium support unit 20.

Upstream side end portions of the plurality of first concave sections 24 and the plurality of second concave sections 26 in the transport direction Y are formed to be upstream side end portions of the medium support unit 20 in the transport direction Y.

As shown in FIG. 2A, the plurality of first concave sections 24 and the plurality of second concave sections 26 are formed in a printing region of the medium support unit 20 in which ink is ejected toward the continuous paper P by the ejecting unit 17. The plurality of first concave sections 24 are formed so as to be lined up in the width direction X at a predetermined interval. Meanwhile, the plurality of second concave sections 26 are respectively formed at a plurality of points in which a distance in the width direction X from a single second concave section 26 (hereinafter referred to as the "second concave section 26K"), which is formed at an end that forms a reference (the right end in FIG. 2A), varies depending on each size in the width direction X of a plurality of kinds of continuous paper P for which use in the printer 11 is expected. Additionally, other than the second concave section 26K, the first concave section 24 are formed on both sides in the width direction X of each second concave section 26.

In addition, supporting walls 27A that configure boundaries between first concave sections 24 that are adjacent in the width direction X, and support the continuous paper P are formed between first concave sections 24 that are adjacent in the width direction X. The supporting walls 27A form portions of peripheral walls which configure the first concave sections 24 in which the transport direction Y is a longitudinal direction. In addition, a supporting wall 27B that configures boundaries between first concave sections 24 and second concave sections 26 that are adjacent in the width direction X, and support the continuous paper P are formed between first concave sections 24 and second concave sections 26 that are adjacent in the width direction X. The supporting walls 27B form portions of peripheral walls which configure the first concave sections 24 and portions of peripheral walls which configure the second concave sections 26 in which the transport direction Y is a longitudinal direction. A supporting wall 27C that configures an upstream side end portion of the medium support unit 20 in the transport direction Y is formed in an upstream side end portion in the transport direction Y of all of the first concave sections 24 and the second concave sections 26. The supporting wall 27C configures a portion of a peripheral wall that configures the first concave sections 24 and the second concave sections 26 in which the width direction X is a longitudinal direction. Upper surfaces of the supporting walls 27A, upper surfaces of the supporting walls 27B, and an upper surface of the supporting wall 27C configure a portion of the support surface 20*a* of the medium support unit 20.

Ribs 25 that extend toward a downstream side in the transport direction Y are formed inside the first concave sections 24.

The ribs 25 rise up from bottom surfaces 24*a* of the first concave sections 24 toward a side of the ejecting unit 17. A height dimension from the bottom surfaces 24*a* of the first concave sections 24 to an upper surface of the ribs 25 is the same as a height dimension from the bottom surfaces 24*a* of the first concave sections 24 to the support surface 20*a*, and in this respect, upper surfaces of the ribs 25 configure a portion of the support surface 20*a*. The ribs 25 extend from an upstream side end portion of the first concave sections 24 in the transport direction Y toward a downstream side. Downstream side end portions of the ribs 25 are positioned further on an upstream side of the first concave sections 24 than central portions thereof in the transport direction Y. In addition, in each first concave section 24 a suction hole 23 is formed further on a downstream side in the transport direction Y than the rib 25. Therefore, the first concave sections 24 are in communication with the internal airspace 22 (refer to FIGS. 1A and 1B) of the medium support unit 20 through the suction hole 23.

As shown in FIG. 2B, on the inside of two first concave sections 24 that are adjacent in the width direction X and interposed between two second concave sections 26, an opening section 24*b* is formed in a region that is close to the upstream side in the transport direction Y. A portion of the image capture unit 30 is inserted into the opening section 24*b* from a lower side. That is, the image capture unit 30 captures an image of a lower surface of the continuous paper P through the opening section 24*b*. Additionally, in the following description, among the first concave sections 24, the two first concave sections 24 in which the opening section 24*b* is formed will be referred to as the "first concave section 24A" and the "first concave section 24B". The dimensions in the transport direction Y of the first concave sections 24A and 24B are larger than the dimensions in the transport direction Y of other first concave sections 24.

Meanwhile, the second concave sections 26 are set to an open shape that is capable of receiving ink that is ejected onto the continuous paper P from the ejecting unit 17 (refer to FIGS. 1A and 1B). The second concave sections 26 have openings in which a width dimension, which is a dimension in the width direction X, is slightly smaller than a width dimension of the first concave sections 24, and in which a dimension in the transport direction Y is larger than a dimension in the transport direction Y of the first concave sections 24 other than the first concave sections 24A and 24B. Additionally, in the following description, the second concave section 26 that is adjacent to the first concave section 24A in the width direction X will be referred to as the "second concave section 26A", and the second concave section 26 that is adjacent to the first concave section 24B in the width direction X will be referred to as the "second concave section 26B".

Next, a configuration of the image capture unit 30 will be described in detail using FIGS. 3 to 5.

As shown in FIG. 3, the image capture unit 30 is provided with a cylindrical lens barrel 31 that extends in a vertical direction Z. The lens barrel 31 is fixed to the medium support unit 20 by a screw 38 (refer to FIG. 2B) at an upper end part thereof, and is fixed to the control unit 18, which has a housing, by a screw (not shown in the drawings) at a lower end part thereof. Additionally, in the present embodiment, a front-rear direction of the medium is defined by an upper surface (a front surface) and a lower surface (a rear surface) of the continuous paper P in a position in the transport device 12 in which the image capture unit 30 is provided. The front-rear direction of the medium is a direction along the vertical direction Z.

An accommodation unit 31*a*, an internal accommodation space of which extends in the transport direction Y is formed in an upper end portion of the lens barrel 31. The accommodation unit 31*a* is a case in which the top is open, and a lens barrel cover 40, which is an example of a support member, is attached to the opening thereof so as to fill the opening from an upper side. An upper end portion of the lens barrel cover 40 is inserted into the opening section 24*b* of the first concave sections 24A and 24B. A colorless and transparent light-transmitting member 32 for allowing the transmission of light while suppressing the entry of foreign substances such as dust into the inside of the image capture unit 30 is fixed to an upper section of the lens barrel cover 40. That is, the opening section 24*b* is filled by the light-transmitting member 32.

A light irradiation unit 33 that irradiates a lower surface of the continuous paper P with light is disposed in an airspace that is formed by the accommodation unit 31*a* and the lens barrel cover 40. The light irradiation unit 33 is a light source such as a light emitting diode of a halogen lamp, and in the present embodiment, is configured by a light emitting diode (LED). The light irradiation unit 33 irradiates light from a lower surface side of the continuous paper P that is transported onto the support surface 20*a* through the light-transmitting member 32 toward the continuous paper P. In this case, the light irradiation unit 33 is disposed so that a lower surface of the continuous paper P is irradiated with light from a side of the width direction X in an oblique manner.

An object side lens 34, which is an example of an optical member that is positioned on an upper side (a side of the medium support unit 20), an image side lens 35, which is an example of an optical member that is positioned on a lower side (a side of the control unit 18), and an aperture 36 that is positioned between the object side lens 34 and the image side lens 35, are accommodated inside the lens barrel 31. The object side lens 34 is a telecentric lens as one example, and collects reflected light in which light that was output from the light irradiation unit 33 and transmitted by the light-transmitting member 32 has been transmitted by the light-transmitting member 32 again and entered the lens barrel 31 after being reflected by a lower surface of the continuous paper P. The aperture 36 narrows a range of light as a result of light that has passed through the object side lens 34 passing therethrough. The image side lens 35 is a telecentric lens as one example, and collects light that has passed through the aperture 36.

An image capture element 37 which has an image capture surface 37*a* on which an image of a lower surface of the continuous paper P that is collected by the image side lens 35 is imaged, is provided in a lower end portion of the lens barrel 31 that is accommodated in the control unit 18. The image capture element 37 is, for example, configured by a two-dimensional image sensor. An image that is captured by the image capture unit 30 is output to a control circuit in the control unit 18 for controlling the transport device 12.

As shown in FIG. 4, a pair of first wall sections 41, which is an example of a pair of wall sections that support the light-transmitting member 32, a second wall section 42 that is formed spaced apart in the width direction X from the pair of first wall sections 41, and a third wall section 43, which is a side wall that is connected to the first wall sections 41 and the second wall section 42, are formed in an upper end portion of the lens barrel cover 40. In addition, a fourth wall section 44, which is formed in a position in the width direction X that corresponds to the light irradiation unit 33, and which configures a portion of an upper wall in the lens barrel cover 40 that is connected to lower portions of the first wall section 41 and the second wall section 42, is formed in the lens barrel cover 40.

As shown in FIGS. 4 and 5, upper surfaces 41*a*, which are upper end surfaces of the pair of first wall sections 41, an upper surface 42*a*, which is an upper end surface of the second wall section 42, and upper surface 43*a*, which is an upper end surface of the third wall section 43 are formed to have the same height in the vertical direction Z as the support surface 20*a* of the medium support unit 20. That is, a dimension in the vertical direction Z (a height dimension Z1) from the bottom surface 24*a* of the first concave sections 24A to the upper surfaces 41*a* to 43*a* is equivalent to a dimension in the vertical direction Z (a height dimension Z2) from the bottom surface 24*a* of the first concave sections 24A to the support surface 20*a*. Therefore, the upper surfaces 41*a* to 43*a* support the continuous paper P when the continuous paper P is transported on the medium support unit 20. In addition, the pair of first wall sections 41 protrude on an upper side (the side of the support surface 20*a*) further than an upper surface 32*a* of the light-transmitting member 32. In other words, the upper surface 32*a* of the light-transmitting member 32 is positioned further on a lower side than the support surface 20*a*.

Additionally, "the height dimension Z1 from the bottom surface 24*a* of the first concave sections 24A to the upper surfaces 41*a* to 43*a* being equivalent to the height dimension Z2 from the bottom surface 24*a* of the first concave sections 24A to the support surface 20*a*" includes a range in which the height dimension Z1 and the height dimension Z2 are slightly shifted with respect to one another due to processing errors or assembly errors of the lens barrel 31 and the lens barrel cover 40. In brief, it is suitable if the height dimension Z1 is substantially the same as the height dimension Z2.

The light-transmitting member 32 is disposed in an upstream side end portion in the transport direction Y of the first concave sections 24A. The light-transmitting member 32 is disposed so that the upper surface 32*a* thereof is beneath the bottom surface 24*a* of the first concave section 24B. A width dimension of the light-transmitting member 32 is half of a width dimension of the first concave sections 24A.

As shown by a dashed line in FIG. 4, since the image capture unit 30 captures an image of a lower surface of the continuous paper P clearly, a focal position in the vertical direction Z of the object side lens 34 is set to the support surface 20*a*. That is, the focal position of the object side lens 34 is set further on an upper side than the upper surface 32*a* of the light-transmitting member 32. In addition, an optical axis direction, which is a direction that runs along an optical axis of the object side lens 34 is parallel with the vertical direction Z. Additionally, there are cases in which portions of the continuous paper P that face the light-transmitting member 32 in the vertical direction Z become slightly more warped on a lower side than the support surface 20*a* as a result of the continuous paper P being suctioned by the suction fan 28. However, as long as a distance in the vertical direction Z between the focal position of the object side lens 34 and a lower surface of the continuous paper P is small, it is possible for the image capture unit 30 to capture an image of a lower surface of the continuous paper P clearly even if the lower surface of the continuous paper P is positioned further on a lower side than the focal position of the object side lens 34 as a result of the lower surface of the continuous paper P being slightly more warped on a lower side than the support surface 20*a*.

As shown in FIG. 5, in the pair of first wall sections 41, the transport direction Y is a longitudinal direction. Wall sections 41A and 41B, which is the pair of first wall sections 41, are formed spaced apart in the width direction X with the light-transmitting member 32 interposed therebetween. Space are formed at both end portions of the pair of first wall sections 41 in the transport direction Y. An accommodation unit 45 is formed by the lens barrel cover 40 and the supporting wall 27C between the light-transmitting member 32 and the supporting wall 27C between the pair of wall sections 41. The accommodation unit 45 is open at the top thereof, and is formed in a concave shape that is indented downward from the upper surface 32*a* of the light-transmitting member 32.

Among the pair of first wall sections 41, the wall section 41A that is on a side of the second concave section 26A is positioned inside the first concave section 24A. The wall section 41A is positioned in a substantially central portion in the width direction X between the supporting wall 27B that forms a boundary wall between the first concave section 24A and the second concave section 26A, and the supporting wall 27A that forms a boundary wall between the first concave sections 24A and 24B.

Among the pair of first wall sections 41, the wall section 41B that is on a side of the second concave section 26B configures a portion of the supporting wall 27A that forms a boundary wall between the first concave sections 24A and 24B. The wall section 41B is configured as an upstream side end portion in the transport direction Y of the supporting wall 27A of the first concave sections 24A and 24B.

In the second wall sections 42, the transport direction Y is a longitudinal direction. The second wall section 42 is positioned in a substantially central portion in the width direction X between the supporting wall 27A that forms a boundary wall between the first concave sections 24A and 24B, and the supporting wall 27B that forms a boundary wall between the first concave section 24B and the second concave section 26B. The second wall section 42 is formed at an upstream side end portion in the transport direction Y of the medium support unit 20.

The third wall section 43 is positioned inside the first concave section 24B. In the third wall section 43, the width direction X is the longitudinal direction, and the third wall section 43 is connected to an upstream side end portion in the transport direction Y of the wall section 41B, and an upstream side end portion in the transport direction Y of the second wall section 42. A notched portion 24*c* is formed at an upstream side end portion in the transport direction Y of the first concave section 24 in which the third wall section 43 is disposed. The third wall section 43 is disposed in a position inside the first concave section 24 at which the notched portion 24*c* is formed. Further, inside the notched portion 24*c*, the third wall section 43 configures a portion of the supporting wall 27C.

The fourth wall section 44, which is a portion of an upper wall of the lens barrel cover 40 is formed as a surface that is parallel to a flat surface that is formed by the width direction X and the transport direction Y. An upper surface 44*a* of the fourth wall section 44 is flush with the bottom surface 24*a* of the first concave section 24B. Further, the fourth wall section 44 covers a portion of the opening section 24*b* from an upper side.

The suction hole 23 that is formed in the first concave section 24A is positioned between the pair of first wall sections 41 in the width direction X, and positioned further on a downstream side than the light-transmitting member 32 in the transport direction Y. The suction hole 23 that is formed in the first concave section 24B is positioned in a central portion of the first concave section 24B in the width direction X, and positioned further on a downstream side than the fourth wall section 44 of the lens barrel cover 40 in the transport direction Y. The suction hole 23 of the first concave section 24A is positioned further on an upstream side in the transport direction Y than the suction hole 23 of the first concave section 24B.

In this manner, according to the abovementioned configuration of the medium support unit 20, and the configurations of the pair of first wall sections 41, the second wall section 42, and the third wall section 43 of the lens barrel cover 40, as shown in FIG. 6, it is possible to support the continuous paper P when cockling, which is a phenomenon in which the continuous paper P becomes wavy in the width direction X as a result of the continuous paper P swelling due printing, occurs.

More specifically, in first concave sections 24 other the first concave sections 24A and 24B and the second concave sections 26, bent portions of the continuous paper P that are on a side of the ejecting unit 17 (an upper side) are adsorbed to upper surfaces of the supporting walls 27A to 27C and upper surfaces of the ribs 25 by the suction fan 28, and bent portions of the continuous paper P that are on a side of the support surface 20*a* (a lower side) are accommodated in the first concave sections 24 and the second concave sections 26. Meanwhile, in the first concave sections 24A and 24B, bent portions of the continuous paper P that are on a side of the ejecting unit 17 (an upper side) are adsorbed to upper surfaces of the pair of first wall sections 41, an upper surface of the second wall section 42, and the supporting walls 27A to 27C, and bent portions of the continuous paper P that are on a side of the support surface 20*a* (a lower side) are accommodated in the first concave sections 24A and 24B. Therefore, rising of the continuous paper P from the support surface 20*a* on the side of the ejecting unit 17 is suppressed.

Next, effects of the printer 11 will be described.

As shown in FIG. 1B, since a position of the continuous paper P that is nipped between the pair of paper supply rollers 13 is positioned above the support surface 20*a* of the medium support unit 20, the continuous paper P that is transported to the medium support unit 20 by the pair of paper supply rollers 13 enters the support surface 20*a* in a manner in which the continuous paper P intersects the support surface 20*a*. As a result of this, it is difficult for the continuous paper P to rise upward from the support surface 20*a* in a region of a predetermined width that is continuous from an upstream side end portion to a downstream side in the transport direction Y in which the continuous paper P intersects the support surface 20*a*, and it is easy for the continuous paper P to rise upward from the support surface 20*a* as the continuous paper P runs further toward a downstream side than the region.

Meanwhile, the image capture unit 30 is designed so that the focal position of the object side lens 34 coincides with the support surface 20*a* on the premise that the continuous paper P is transported adsorbed to the support surface 20*a*. Therefore, if the image capture unit 30 is configured to capture an image of a lower surface of the continuous paper P that is transported to the abovementioned region of a predetermined width, since it is likely that the lower surface of the continuous paper P and the focal position of the object side lens 34 will coincide, it is possible to capture an image of the texture of the lower surface of the continuous paper P clearly. Therefore, it is preferable that the opening section 24*b* for irradiating the lower surface of the continuous paper P with light from the light irradiation unit 33 is formed in the above-mentioned region of a predetermined width, and that the light-transmitting member 32 is positioned inside the opening section 24*b*. As the region of a predetermined width, in the present embodiment, the opening section 24*b* is formed at an upstream side end portion in the transport direction Y of the first concave section 24A. As shown in FIG. 6, at the upstream side end portion in the transport direction Y of the first concave section 24A, the continuous paper P is adsorbed to the support surface 20*a* by the first concave sections 24 and the second concave sections 26. Therefore, it is difficult for a lower surface of the continuous paper P to rise further upward from the support surface 20*a*. Accordingly, it is possible for the image capture unit 30 to capture an image of the texture of the lower surface of the continuous paper P clearly.

Further, the upper surface 32*a* of the light-transmitting member 32 is positioned below the support surface 20*a*. Therefore, the focal position of the object side lens 34 and the upper surface 32*a* of the light-transmitting member 32 become positions that differ in the vertical direction Z. As a result of this, even if foreign substances such as paper powder of the continuous paper P become adhered to the upper surface 32*a* of the light-transmitting member 32, the foreign substances do not reach the focal point of the object side lens 34. Therefore, even if foreign substances appear in a captured image unexpectedly, the texture of the lower surface of the continuous paper P forms a clear image, and therefore, since the foreign substances form an unclear image, the effect of foreign substances on a captured image is reduced.

In addition, it becomes more difficult to stabilize the attitude of the continuous paper P that is supported by the support surface 20*a* as the first concave sections 24 become separated from the pair of paper supply rollers 13 (refer to FIGS. 1A and 1B) on a downstream side. Therefore, the first concave sections 24 it is preferable that the first concave sections 24 are brought as close to the pair of paper supply rollers 13 as possible, that is, that the first concave sections 24 are provided at an upstream side end portion in the transport direction Y of the medium support unit 20.

In such an instance, in the present embodiment, as shown in FIG. 5, the opening section 24*b* for image capture of the lower surface of the continuous paper P by the image capture unit 30 is formed inside the first concave sections 24A and 24B, and the light-transmitting member 32 is disposed inside the opening section 24*b*. According to this configuration, it is possible to form the first concave sections 24A and 24B and the opening section 24*b* in a region of a predetermined width that is continuous from an upstream side end portion to a downstream side in the transport direction Y in which the continuous paper P intersects the support surface 20*a*. Therefore, in the region of a predetermined width, it is possible to support and displace the continuous paper P downward.

However, since a dimension of the opening section 24*b* in the width direction X is large, in the first concave sections 24A and 24B for capturing an image of the continuous paper P using the image capture unit 30, a portion of the supporting wall 27A that forms a boundary wall between the first concave sections 24A and 24B, and the ribs 25 of the first concave sections 24A and 24B are cut away. Therefore, as long as the portion of the supporting wall 27A and the ribs 25 are in the cut away state, there is a concern that the continuous paper P will not be supported stably by the first concave sections 24A and 24B.

In such an instance, as shown in FIG. 6, in the present embodiment, with respect to the first concave sections 24A and 24B, since the wall section 41B of the first wall section 41 of the lens barrel cover 40 configures an upstream side end portion in the transport direction Y of the supporting wall 27A, even if a portion of the supporting wall 27A us cut away as a result of the opening section 24*b* being formed, the upper surface 41*a* of the wall section 41B supports the continuous paper P.

Additionally, in the present embodiment, since the wall section 41A of the first wall sections 41 and second wall section 42 are positioned in substantially central portions in the width direction X of the first concave sections 24, and at upstream side end portion in the transport direction Y, the wall section 41A and the second wall section 42 are provided with the same function as the ribs 25. Therefore, the upper surface 41*a* of the wall section 41A and the upper surface 42*a* of the second wall section 42 support the continuous paper P.

In this manner, since the wall sections 41A and 41B and the second wall section 42 of the lens barrel cover 40 also serve a function of the medium support unit 20 of supporting the continuous paper P, deteriorations in the function of supporting the continuous paper P are suppressed even if the light-transmitting member 32 is positioned at an upstream side end portion in the transport direction Y of the first concave section 24.

According to the printer 11 of the present embodiment, it is possible to obtain the following effects.

(1) Since the upper surface 32*a* of the light-transmitting member 32 is positioned below the focal position of the object side lens 34, even if foreign substances become adhered to the upper surface 32*a* of the light-transmitting member 32, since the effect of foreign substances on a captured image is small, a circumstance in which an incorrect template position is detected during a template matching process for detecting a transport weight, is suppressed. Therefore, it is possible to suppress deteriorations in the precision of detection of the transport weight of the continuous paper P by the control unit 18.

That is, even if foreign substances become adhered to a surface that is on a second side of the light-transmitting member in the front-rear direction of the medium, the foreign substances are positioned further on a first side in the front-rear direction than a focal position of the optical member. As a result of this, in the front-rear direction of the medium, since the foreign substances that are adhered to a surface that is on a second side of the light-transmitting member do not coincide with the focal position of the optical member, an image of a surface that is on a first side in the front-rear direction of the medium is captured clearly, and an image of the foreign substances is not captured clearly. Therefore, the image capture unit reduces the effect of foreign substances on captured images. Accordingly, it is possible to suppress deteriorations in the precision of detection of the transport weight of the medium on the basis of images of the image capture unit.

(2) Since the opening section 24*b* is formed inside the first concave sections 24A and 24B, and the light-transmitting member 32 is positioned inside the opening section 24*b*, it is possible for the first concave sections 24, including the first concave sections 24A and 24B, to be formed in a region of a predetermined width that is continuous from an upstream side end portion to a downstream side of the medium support unit 20. Therefore, in the region, since the continuous paper P is deformed downward in a bending manner and supported by the first concave sections 24A and 24B even in a case in which there are portions in which the continuous paper P has been deformed in a bending manner in a direction (upward) that rises from the support surface 20*a* due to the cockling phenomenon, it is possible to suppress a circumstance in which the continuous paper P rises from the support surface 20*a*. Therefore, in the above-mentioned region of a predetermined width, it is possible to suppress a circumstance in which the continuous paper P and the ejecting unit 17 come into contact with one another.

That is, the light-transmitting member, which transmits light for medium image capture from the image capture unit, is disposed in the support surface of the medium support unit inside a concave section that is indented from the support surface on a first side in the front-rear direction of the medium. Therefore, in a case in which the medium is deformed in a bending manner on the support surface, it is possible for portions of the medium that are positioned in a disposition region of the light-transmitting member to be displaced and supported further on the first side in the front-rear direction of the medium than the support surface. Accordingly, even in a case in which portions of the medium that are deformed in a bending manner are positioned on the light-transmitting member, a circumstance in which the portions that are deformed in a bending manner rise from the support surface is suppressed.

In addition, the light-transmitting member is disposed in the support surface of the medium support unit inside a concave section that is indented further in a direction that becomes separated from the ejecting unit than the support surface. Therefore, in a case in which the medium is deformed in a bending manner on the support surface, it is possible for portions of the medium that are positioned in a disposition region of the light-transmitting member to be displaced and supported further in a direction that becomes separated from the ejecting unit than the support surface. Accordingly, even in a case in which portions of the medium that are deformed in a bending manner are positioned on the light-transmitting member, a concern that the portions that are deformed in a bending manner will come into contact with the ejecting unit is reduced.

(3) When the continuous paper P is transported on the pair of first wall sections 41 of the lens barrel cover 40, there are cases in which foreign substances such as paper powder of the continuous paper P become adhered to the light-transmitting member 32. There is a concern that a precision of detection of the transport weight of the continuous paper P will deteriorate if foreign substances that are adhered to the light-transmitting member 32 appear in images captured by the image capture unit 30 unexpectedly.

In such an instance, in the present embodiment, in the first concave section 24A, the suction hole 23 is formed on a downstream side of the light-transmitting member 32 in the transport direction Y. Since the suction fan 28 suctions air between the continuous paper P and the first concave section 24A through the suction hole 23, the continuous paper P that faces the light-transmitting member 32 is suctioned. Therefore, air flow toward the downstream side in the transport direction Y is formed between the pair of first wall sections 41. That is, air flow from the light-transmitting member 32 toward to the suction hole 23 is formed on the upper surface 32*a* of the light-transmitting member 32. As a result of this, foreign substances that are adhered to the upper surface 32*a* of the light-transmitting member 32 are suctioned into the suction hole 23. Therefore, foreign substances that are adhered to the upper surface 32*a* of the light-transmitting member 32 are removed.

That is, in a case in which the suction unit suctions air that is in an airspace between the light-transmitting member and the medium through the suction hole, air flow from the light-transmitting member toward to the suction hole is formed on a surface of the second side in the front-rear direction of the medium of the light-transmitting member. Therefore, in a case in which foreign substances are adhered to the surface of the second side in the front-rear direction of the medium of the light-transmitting member, the foreign substances are removed from the surface of the second side in the front-rear direction of the medium of the light-transmitting member by the air flow.

In addition, since the suction unit suctions air that is in an airspace between the light-transmitting member and the medium through the suction hole, air flow from the light-transmitting member toward the suction hole is created on a surface of the light-transmitting member that faces the ejecting unit. Therefore, in a case in which foreign substances are adhered to the surface of the light-transmitting member that faces the ejecting unit, the foreign substances are removed from the light-transmitting member by the air flow.

(4) When a back end portion in the transport direction Y of the continuous paper P passes over the light-transmitting member 32 or the suction hole 23 that are formed in the first concave section 24A, air inside an airspace that is formed between the continuous paper P and the first concave section 24 is introduced from an opening section that is formed by the back end portion of the continuous paper P and the first concave section 24A, and is open in the transport direction Y. As a result of this, air flow from an upstream side in the transport direction Y to a downstream side is generated inside the airspace between the continuous paper P and the first concave section 24. The air flow is guided over the upper surface 32*a* of the light-transmitting member 32 by the pair of first wall sections 41 of the lens barrel cover 40 in the manner that is shown by a dashed-dotted line arrow in FIG. 7. As a result of this, the air flow passes over the upper surface 32*a* of the light-transmitting member 32. Therefore, since foreign substances that are adhered to the upper surface 32*a* of the light-transmitting member 32 move to the downstream side in the transport direction Y due to the air flow, foreign substances are removed from the upper surface 32*a* of the light-transmitting member 32.

That is, when an end portion in the transport direction of the medium passes over the suction hole or the light-transmitting member, air inside an airspace that is formed between the medium and the concave section is introduced from an opening section in the transport direction that is formed by the end portion in the transport direction of the medium and the concave section. Therefore, air flow in the transport direction is generated inside the airspace that is formed between the medium and the concave section. The air flow is guided over a surface of a second side in the front-rear direction of the medium of the light-transmitting member by the pair of wall sections. As a result of this, in a case in which foreign substances are adhered to the light-transmitting member, the foreign substances move toward the transport direction due to the air flow. Accordingly, it is possible to remove foreign substances from the light-transmitting member.

In addition, when an end portion in the transport direction of the medium passes over the suction hole or the light-transmitting member, air inside an airspace that is formed between the medium and the concave section is introduced from an opening section in the transport direction that is formed by the end portion in the transport direction of the medium and the concave section. Therefore, air flow in the transport direction is generated inside the airspace that is formed between the medium and the concave section. The air flow is guided over a surface of the light-transmitting member that is on a side of the ejecting unit by the pair of wall sections. As a result of this, in a case in which foreign substances such as dust are adhered to the light-transmitting member, the foreign substances move toward the transport direction due to the air flow. Accordingly, it is possible to remove foreign substances from the light-transmitting member.

(5) Side walls that connect end portions in the transport direction Y of the pair of first wall sections 41 to the width direction X are not formed in the pair of first wall sections 41 of the lens barrel cover 40. According to this configuration, it is possible to remove foreign substances such as paper powder that are adhered to the upper surface 32*a* of the light-transmitting member 32 to further on an upstream side or a downstream side than the light-transmitting member 32 as a result of a user sweeping the upper surface 32*a* of the light-transmitting member 32 using a sweeping member such as a brush or a cotton swab. In addition, since the accommodation unit 45 (refer to FIG. 5) is formed between the light-transmitting member 32 and the medium support unit 20, it is possible for a user to accommodate foreign substances in the accommodation unit 45 using the sweeping member. Therefore, sweeping of the light-transmitting member 32 is made easier.

In addition, as a result of airflow that is generated when the back end portion in the transport direction Y of the continuous paper P passes over the suction hole 23 that is formed in the first concave section 24 passing between the pair of first wall sections 41 as described in (4) above, it is easy for air flow to be introduced over the upper surface 32*a* of the light-transmitting member 32. Therefore, it is easy to remove foreign substances that are adhered to the upper surface 32*a* of the light-transmitting member 32 using the air flow.

(6) Since the wall section 41A of the first wall section 41 of the lens barrel cover 40 is provided with the same function as the supporting wall 27A, it is possible to form the first concave sections 24 and the second concave sections 26 at an upstream side end portion in the transport direction Y of the medium support unit 20, that is, it is possible to form the first concave sections 24 and the second concave sections 26 in positions that are adjacent to the pair of paper supply rollers 13. Therefore, it is easy to stabilize the attitude of the continuous paper P that is transported onto the support surface 20*a* of the medium support unit 20 by the pair of paper supply rollers 13 in the printing region.

That is, in the concave sections, the wall sections of the support member support the medium in place of the peripheral walls that are cut away even in a case in which a portion of the peripheral walls of the concave sections are cut away by the opening section as a result of the opening section being formed in the concave sections. Therefore, an amount by which the medium is bent in a direction that becomes separated from the ejecting unit is reduced. Accordingly, it is possible to suppress deteriorations in the precision of landing positions of liquid.

(7) Since the wall section 41B and the second wall section 42 of the first wall section 41 of the lens barrel cover 40 are provided with the same function as the ribs 25, it is possible to support the continuous paper P at an upstream side end portion in the transport direction Y of the first concave section 24A, and it is possible to reduce a downward bending amount of the continuous paper P.

(8) Since the focal position of the optical member is set within a range from a position that is further on the second side in the front-rear direction of the medium than a surface of the second side of the light-transmitting member to a surface on which the support member supports the medium, in a case in which the focal position of the optical member coincides with the support surface, when the medium is barely bent from the support surface toward a first side in the front-rear direction of the medium, it is possible for the optical member to be aligned with the focal point of the optical member at a surface on the first side in the front-rear direction of the medium. Therefore, it is possible to capture an image of the medium clearly. In addition, in the front-rear direction of the medium, in a case in which the focal position of the optical member becomes a position that is further on the second side than a surface of the light-transmitting member that is on the second side and a position that is further on the first side than the support surface, it is possible to capture an image of a state in which the medium is bent and deformed from the support surface to the first side in the front-rear direction of the medium.

(9) Since the support surface 20*a* of the medium support unit 20 and the upper surfaces 41*a* to 43*a* of each wall sections 41 to 43 are formed to be flush, a circumstance in which a difference in levels is formed between the support surface 20*a* and the upper surfaces 41*a* to 43*a* is suppressed. Therefore, when the continuous paper P is transported over the medium support unit 20, a circumstance in which the continuous paper P becomes caught in a difference in levels is suppressed. Accordingly, the continuous paper P is transported smoothly.

That is, a circumstance in which surfaces of the wall sections of the support member and the support surface of the medium support unit form a difference in levels in the transport direction is suppressed. Therefore, a circumstance in which the medium becomes caught in a difference in levels is suppressed. Accordingly, the medium is transported smoothly.

(10) Since the light-transmitting member 32 is positioned below the support surface 20*a* of the medium support unit 20 and the upper surfaces 41*a* to 43*a* of each wall sections 41 to 43, the light-transmitting member 32 is positioned below the focal point of the object side lens 34 that is set to a position of a lower surface of the continuous paper P, that is, the positions of the support surface 20*a* and the upper surfaces 41*a* to 43*a*. Therefore, even if foreign substances are adhered to the light-transmitting member 32, it is unlikely that the foreign substances will appear in images that are captured by the image capture unit 30. Accordingly, since it is unlikely that a detection error of the image capture unit 30 will be generated as a result of foreign substances that are adhered to the light-transmitting member 32, it is possible for the control unit 18 to precisely calculate the transport weight of the continuous paper P.

(11) A width dimension, which is a dimension in the width direction X of the supporting wall 27A that forms a boundary wall between the first concave sections 24A and 24B is smaller than a width dimension, which is a dimension in the width direction X of the light-transmitting member 32. Therefore, in comparison with a configuration in which the width dimension of the supporting wall 27A is larger than the width dimension of the light-transmitting member 32, it is easier to accommodate portions of the continuous paper P that are deformed downward in a bending manner, which are adjacent to portions that are deformed in a direction that rises from the support surface 20*a* in a bending manner due the cockling phenomenon, in the first concave sections 24A and 24B. Therefore, it is possible to suppress a circumstance in which the continuous paper P rises from the support surface 20*a*.

Additionally, the abovementioned embodiment may be modified to the following other embodiments.

In the abovementioned embodiment, there may be two or more suction holes 23 that is formed inside the first concave sections 24.

In the abovementioned embodiment, as shown in FIG. 8, the opening section 24*b* may be formed further on a downstream side than the upstream side end portion in the transport direction Y of the first concave sections 24A and 24B. In addition, the opening section 24*b* may be formed in a portion in which a portion of the supporting wall 27A of the first concave sections 24A and 24B has been notched. In this case, the light-transmitting member 32 is disposed so as to extend over the first concave sections 24A and 24B.

As shown in FIG. 8, the opening section 24*b* may be formed on a downstream side in the transport direction Y of the first concave sections 24A and 24B, and the suction holes 23 may be formed on both sides of the light-transmitting member 32 in the transport direction Y. The positions of the suction holes 23 in the width direction X are equivalent to positions that are between the pair of first wall sections 41 in the width direction X.

According to this configuration, when a front end portion in the transport direction Y of the continuous paper P passes over the suction hole 23 or the light-transmitting member 32 that are on the upstream side of the first concave sections 24A and 24B in the transport direction Y, air inside an airspace that is formed between the continuous paper P and the first concave sections 24A and 24B is introduced from an opening section that is formed by the front end portion of the continuous paper P and the first concave sections 24A and 24B, and is open in the transport direction Y. As a result of this, air flow from a downstream side in the transport direction Y to an upstream side is generated inside the airspace between the continuous paper P and the first concave sections 24A and 24B in the manner that is shown by a dashed-dotted line arrow in the drawing. Since foreign substances that are adhered to the upper surface 32*a* move toward the suction hole 23 that is on the upstream side of the first concave sections 24A and 24B in the transport direction Y due to the air flow passing over the upper surface 32*a* of the light-transmitting member 32, foreign substances are removed from the upper surface 32*a*.

In addition, when a back end portion in the transport direction Y of the continuous paper P passes over the light-transmitting member 32 or the suction hole 23 that are on the downstream side of the first concave sections 24A and 24B in the transport direction Y or the light-transmitting member 32, air inside an airspace that is formed between the continuous paper P and the first concave sections 24A and 24B is introduced from an opening section that is formed by the back end portion of the continuous paper P and the first concave sections 24A and 24B, and is open in the transport direction Y. As a result of this, air flow from an upstream side in the transport direction Y to a downstream side is generated inside the airspace between the continuous paper P and the first concave sections 24A and 24B. Foreign substances that are adhered to the upper surface 32*a* are removed in the same manner as a result of the air flow passing over the upper surface 32*a* of the light-transmitting member 32.

In the abovementioned embodiment, at least one of the first wall section 41, the second wall section 42 and the third wall section 43 may be positioned below the support surface 20*a* of the medium support unit 20 within a range in which each wall section 41 to 43 is capable of supporting the continuous paper P.

In the abovementioned embodiment, the lens barrel cover 40 may configure the entirety of the first concave sections 24A and 24B.

In the abovementioned embodiment, one of the pair of first wall sections 41 of the lens barrel cover 40 may be omitted.

In the abovementioned embodiment, the second wall section 42 of the lens barrel cover 40 may form a portion of the rib 25 only.

In the abovementioned embodiment, the second wall section 42 of the lens barrel cover 40 may be omitted.

In the abovementioned embodiment, there may be two or more ribs 25 that are formed in the first concave sections 24. A plurality of ribs 25 are formed spaced apart in the width direction X.

In the abovementioned embodiment, the ribs 25 of the first concave sections 24 may be omitted.

In the abovementioned embodiment, a communication section that is in communication with an airspace that is further on a side of the pair of paper supply rollers 13 than the medium support unit 20, and an airspace between the first concave section 24A and the continuous paper P may be formed in the supporting wall 27C that configures the first concave section 24A. As a result of this, when the continuous paper P is transported, external air is introduced into an airspace between the first concave section 24A and the continuous paper P through the communication section. Therefore, it is easier for the airflow that is shown by the dashed-dotted line arrow in FIG. 7 to be generated.

In the abovementioned embodiment, the first concave sections 24A and 24B may be omitted. In this case, the opening section 24*b* is formed in the support surface 20*a*. In addition, the light-transmitting member 32 is disposed further on a lower side than the support surface 20*a* of the medium support unit 20, that is, a focal position of the object side lens 34.

In the abovementioned embodiment, the focal position of the object side lens 34 may be set within a range of further on an upper side than the upper surface 32*a* of the light-transmitting member 32, and further on a lower side than the support surface 20*a* of the medium support unit 20.

According to this configuration, when the continuous paper P is suctioned downward by the suction fan 28 through the suction hole 23, the continuous paper P is bent downward in the first concave section 24A. Since the image capture unit 30 captures an image of a lower surface of the continuous paper P that is on the first concave section 24A, the image capture unit 30 captures an image of the continuous paper P that is bent downward. In such an instance, according to this configuration, since the focal position of the object side lens 34 is set further on a lower side than the support surface 20*a*, it is possible to align the focal point at the lower surface of the continuous paper P that is bent downward. Therefore, it is possible to capture an image of the texture of the lower surface of the continuous paper P clearly.

The printing apparatus is not limited to a printer that is provided with a printing function only, and may be a multifunction machine. Furthermore, the printing apparatus is not limited to a serial printer, and may be a line printer or a page printer.

The printing apparatus (medium transport device) may have a configuration in which the winding unit 15 and the tension roller 16 are omitted.

The liquid ejecting apparatus may be adopted in a thermal jet printer, or adopted in a solid ink jet printer.

The liquid ejecting apparatus may be adopted in a serial printer, may be adopted in a line printer, and may be adopted in a page printer.

The liquid ejecting apparatus may have a configuration in which the winding unit 15 and the tension roller 16 are omitted.

The medium is not limited to continuous paper, and may be single sheets of paper, a resin film, a metallic foil, a metallic film, a composite film of resin and metal (a laminated film), a fabric, a non-woven fabric, a ceramic sheet or the like.

In the abovementioned embodiment, a liquid other than ink may be ejected from the ejecting unit 17 onto the continuous paper P as a minute amount of liquid droplets. As a state of the liquid, it is possible to include granules, tears, and filaments that leave a trail. In addition, the liquid that is referred to in this instance may be any material that is capable of being ejected from the ejecting unit 17. For example, the liquid may include any substance that is in a state in which the physical properties are in a liquid phase, liquids with high or low viscosities, sols, gel waters, other inorganic solvents, organic solvents, solutions, or fluids such as liquid resins. In addition, the liquid may include not only liquids for which the physical properties are in a single state, and may include liquids in which particles that are made from solid objects such as pigments are dissolved, dispersed or mixed in solvents. In a case in which the liquid is ink, ink can include general aqueous ink and oil-based ink, and various liquid compositions such as gel ink, hot melt ink and the like.

The medium transport device is not limited to being provided in a printing apparatus, and may be provided in a processing apparatus in which a process other than printing is carried out. The medium transport device may transport a medium other than continuous paper. For example, the medium transport device may be adopted in a drying apparatus that transports a medium inside drying equipment in order to dry the medium. In addition, the medium transport device may be adopted in a surface processing apparatus that carries surface processing such as coating or a surface improvement process on a medium. In addition, the medium transport device may be adopted in a manufacturing apparatus that carries out punching work on a medium. Furthermore, the medium transport device may be adopted in a plating apparatus that carries out non-electrolytic plating on a medium. The medium transport device may be adopted in a circuit formation apparatus that prints circuits onto a tape-like substrate. The medium transport device may be adopted in a measurement apparatus that acquires a measurement value of the thickness, surface roughness or the like of a medium. Furthermore, the medium transport device may be adopted in a detection apparatus that detects a medium.

What is claimed is:

1. A liquid ejecting apparatus comprising:

a transport unit configured to transport a medium;

an ejecting unit configured to eject a liquid onto the medium;

an image capture element configured to capture an image of a first surface of the medium, the medium being transported by the transport unit;

a light-transmitting member configured to transmit light for capturing the image by the image capture element, the light being from the first surface of the medium;

a support member configured to support the medium and to be disposed in the opening section, the light-transmitting member being disposed on the support member; and a medium support unit having a support surface, the support surface having a concave section, the concave section being indented in a direction toward the image capture unit, wherein the medium support unit has an opening section inside the concave section, the light-transmitting member being disposed in the opening section, wherein there is open space between the light-transmitting member and the support surface such that the light-transmitting member does not contact the medium supported by the support surface, wherein, when the transported medium is supported by the support member, a distance between the medium and the light-transmitting member is longer than a distance between the medium and the support member, and wherein the image capture element, the light-transmitting member, and the support member are integrally detachable from the liquid ejecting apparatus.

2. The liquid ejecting apparatus according to claim 1, further comprising:

an optical member disposed between the light-transmitting member and the image capture element in the direction, wherein the optical member and the image capture element are disposed on a first side of the light-transmitting member, and wherein a focal position of the optical member is positioned on a second side of the light transmitting member, the second side being opposite to the first side.

3. The liquid ejecting apparatus according to claim 1, wherein the image capture element and the light-transmitting member are disposed on a first side of the support surface, and wherein the ejecting unit is disposed on a second side of the support surface, the second side being opposite to the first side.

4. The liquid ejecting apparatus according to claim 1, further comprising:

a control unit configured to detect a transport amount of the medium that is transported by the transport unit on the basis of the image of the first surface of the medium captured by the image capture element.

5. The liquid ejecting apparatus according to claim 4, wherein the control unit controls the transport unit on the basis of the detected transport amount of the medium.

6. The liquid ejecting apparatus according to claim 5, wherein the control unit controls the ejecting unit on the basis of the detected transport amount of the medium.

7. A medium transport device comprising:

a transport unit configured to transport a medium;

an image capture element configured to capture an image of a first surface of the medium, the medium being transported by the transport unit;

a light-transmitting member configured to transmit light for capturing the image by the image capture element, the light being from the first surface of the medium;

a support member configured to support the medium and to be disposed in the opening section, the light-transmitting member being disposed on the support member; and a medium support unit having a support surface, the support surface having a concave, the concave being indented in a direction toward the image capture unit, wherein the medium support unit has an opening section inside the concave section, the light-transmitting member being disposed in the opening section, wherein there is open space between the light-transmitting member and the support surface such that the light-transmitting member does not contact the medium supported by the support surface, wherein, when the transported medium is supported by the support member, a distance between the medium and the light-transmitting member is longer than a distance between the medium and the support member, and wherein the image capture element, the light-transmitting member, and the support member are integrally detachable from the liquid ejecting apparatus.

8. The medium transport device according to claim 7, further comprising:

an optical member disposed between the light-transmitting member and the image capture element in the direction, wherein the optical member and the image capture element are disposed on a first side of the light-transmitting member, and wherein a focal position of the optical member is positioned on a second side of the light transmitting member, the second side being opposite to the first side.

9. The medium transport device according to claim 7, further comprising:

a control unit configured to detect a transport amount of the medium that is transported by the transport unit on the basis of the image of the first surface of the medium captured by the image capture element.

10. The medium transport device according to claim 9, wherein the control unit controls the transport unit on the basis of the detected transport amount of the medium.

11. A medium transport device comprising:

a transport unit configured to transport a medium, a medium support unit having a support surface on which the medium is supported, an image capture element configured to capture an image of a first surface of the medium, the medium being transported by the transport unit;

a light-transmitting member disposed on a second side of an optical member and configured to transmit light for capturing the image by the image capture element, the light being from the first surface of the medium; and a pair of wall sections, to which the light-transmitting member is fixed, wherein, when the transported medium is supported on the support surface, a distance between the medium and a first surface of the light-transmitting member is longer than a distance between the medium and first surfaces of the pair of wall sections, the first surface of the light-transmitting member facing the supported medium, and the first surfaces of the pair of wall sections facing the supported medium, and wherein the image capture element, the light-transmitting member, and the pair of wall sections are integrally detachable.

* * * * *